United States Patent [19]

Whitmore

[11] 4,092,882

[45] June 6, 1978

[54] WATER CLOSET FLANGE WRENCH AND PULLER

[75] Inventor: Floyd Evans Whitmore, Ellington, Conn.

[73] Assignee: Whitmore Tool & Die Co., Inc., Vernon, Conn.

[21] Appl. No.: 649,734

[22] Filed: Jan. 16, 1976

[51] Int. Cl.[2] ..... B25B 13/02

[52] U.S. Cl. ..... 81/90 C; 33/371; 81/71

[58] Field of Search ..... 29/200 H; 7/1 M; 33/370, 371; 81/71, 90 C

[56] References Cited

U.S. PATENT DOCUMENTS

| | | | |
|---|---|---|---|
| 1,579,992 | 4/1926 | Altman | 81/90 C |
| 1,882,462 | 10/1932 | Weber | 81/90 C |
| 2,746,163 | 5/1956 | Moritz | 33/370 |
| 2,770,991 | 11/1956 | Myers | 81/90 C |
| 2,881,648 | 4/1959 | Hottle | 81/90 C |
| 3,822,481 | 7/1974 | Doan | 33/371 |
| 3,903,576 | 9/1975 | Stein | 29/200 H X |

*Primary Examiner*—James L. Jones, Jr.
*Assistant Examiner*—James G. Smith
*Attorney, Agent, or Firm*—Lawrence A. Cavanaugh

[57] ABSTRACT

The invention is a water closet flange wrench and puller comprising a base element having alignment means on each end, and having a pair of line-up studs which are attached to the bottom surface of said base element and are slideable engageable with the respective bolt head receiving slots in the water closet flange. The line-up studs are aligned with the axis of the water closet flange bolt head receiving slots, and the head element engages the bolt head receiving slots allowing the flange to be rotated in the clockwise or counterclockwise direction or to be pulled from the soil pipe. The base element contains a means of indicating the alignment of the water closet flange bolt head receiving slots for proper mating with a water closet. The water closet flange wrench and puller has a handle attached to the top surface of the base element to facilitate rotating the water closet flange for proper alignment and to pull an improperly aligned water closet flange from a soil pipe.

6 Claims, 4 Drawing Figures

WATER CLOSET FLANGE WRENCH AND PULLER

BACKGROUND OF THE INVENTION

1. Field of Invention

The present invention relates to a water closet flange wrench and puller, and more particularly to a tool for installing and removing water closet flanges from soil pipes and for aligning water closet bolt head receiving slots in the water closet flange for proper mating with water closet connections.

2. Description of Prior Art

In the installation of water closet flanges, it is necessary to position the water closet flange in such a manner that its bolt head receiving slots will be in proper alignment with the bolt holes of a mating water closet.

Proper alignment requires that the water closet flange bolt head receiving slots be positioned exactly so that when a water closet is mated to the water closet flange, the bolt holes are in proper alignment. This alignment is critical since an inaccuracy in the rotational position of the water closet flange bolt head receiving slot may result in an undesirable rotation of the water closet, with the resulting difficulty of making other water connections, obtaining a leak tight connection, or with the water closet being at an undesirable angle to the wall.

In order to properly position the flange for permanent attachment to the soil pipe, it is customary to position a level or straight edge across the two bolt head receiving slots and rotate the flange until the axis through the center of the bolt head receiving slots coincides with a horizontal plane.

In many instances, bolts are inserted into the bolt head receiving slots and a level or straight edge is rested on the bolts. The water closet flange is then either hammered into alignment, or a lever is applied between the bolts for rotation. At best, this technique is poor for use with metal water closet flanges and is undesirable for plastic water closet flanges.

Once the water closet flange is in alignment, it is then permanently attached to a soil pipe. Metal flanges require a lead joint, whereas plastic flanges are glued into place.

It is the usual practice when installing plastic pipes and flanges to apply a coating of glue to the soil pipe and to the water closet flange before inserting the water closet flange onto the soil pipe. This practice requires that the water closet flange be installed and aligned before the glue hardens. An improperly installed or aligned water closet flange will normally require the cutting and removal of the section of pipe to which the water closet flange is connected and the insertion of a new section of pipe, new coupling connections and a new water closet flange. As well as being expensive and time consuming, this can result in a considerable amount of wall or floor damage when the installation is being done in finished areas as occurs, for example, when remodeling is the order of the day.

In the past there has been no tool designed for the purpose of water closet flange installation, removal or alignment.

SUMMARY OF THE INVENTION

According to the present invention, there is provided a water closet flange wrench and puller which solves the problems encountered heretofore.

The present water closet flange wrench and puller is a convenient and simple-to-use tool which is capable of accurately and quickly providing indication as to the alignment of a water closet flange with mating water closet bolt holes. The tool also provides the capability of removing quickly an improperly aligned plastic water closet flange from a soil pipe before the glue permanently connects the water closet flange to the soil pipe.

Briefly, the present water closet flange wrench and puller comprises a base element having alignment means on each end. Attached to the bottom surface of said base element are a pair of line-up studs which are slideably engagable with the respective bolt head receiving slots in the water closet flange, and which align themselves with the axis of the water closet flange bolt head slots. The present invention consists further of a handle for grasping the tool and for applying a torque to rotate the water closet flange into proper alignment. The handle may be used also to push the water closet flange onto the soil pipe or to pull the water closet flange from the soil pipe. Also comprising part of the invention is a leveling means for determining horizontal leveling of the water closet flange bolt head receiving slots for wall outlet water closets.

OBJECTS

It is the general object of the present invention to provide a water closet flange wrench and puller having line-up studs adapted to position the bolt head receiving slots of a water closet flange for alignment with the bolt holes of a water closet.

Another object of this invention is to provide a water closet wrench which can be readily installed and removed from the water closet flange from a position at the face side of the water closet flange when said water closet flange is inserted into a wall or floor.

A further object of this invention is to provide a water closet wrench which can readily rotate a water closet flange in a clockwise or counterclockwise direction in order to obtain proper alignment with the bolt holes of a water closet.

Another object of this invention is to provide a tool to install plastic water closet flanges and to align readily the bolt head receiving slots of the plastic water closet flange before the glue hardens and prevents further adjustment of said flange.

Another object of this invention is to provide a tool to remove readily a plastic water closet flange from a soil pipe before the glue hardens and prevents adjustments or removal.

Another object of this invention is to provide a tool to align readily and to hold the alignment while the water closet flange is being secured to a soil pipe.

Another object of this invention is to provide a tool to install and align water closet flanges having threads for attachment to threaded soil pipes.

Another object of this invention is to provide a tool to align readily and to hold the alignment of a metal water closet flange while the water closet flange is being lead caulked.

An important feature of the present invention resides in the adaption of the line-up studs for rotating the water closet flange in either the clockwise or counterclockwise direction.

Another feature of the present invention resides in the flat, curvilinear shaped head element of the line-up studs which, when engaged in the bolt head receiving slots of the water closet flange, become firmly engaged with the water closet flange, allowing the water closet flange to be pulled away from a soil pipe when a force is applied by the tool which is normal to the water closet flange.

A further feature of the present invention resides in the wide base of the tool for pushing the water closet flange onto the connecting soil pipe.

Another feature of the present invention resides in the spirit level which horizontally aligns the bolt head receiving slots of the water closet flange.

Another feature of the present invention resides in the alignment provisions on the base element of the tool for the purpose of properly aligning the water closet flange bolt head receiving slots to lie along a line parallel to the wall against which the water closet is being installed.

These, together with other objects and features of the present invention, will be more readily understood from the following description when taken in connection with the accompanying drawings wherein:

DESCRIPTION OF THE PREFERRED EMBODIMENT

Figure 1:
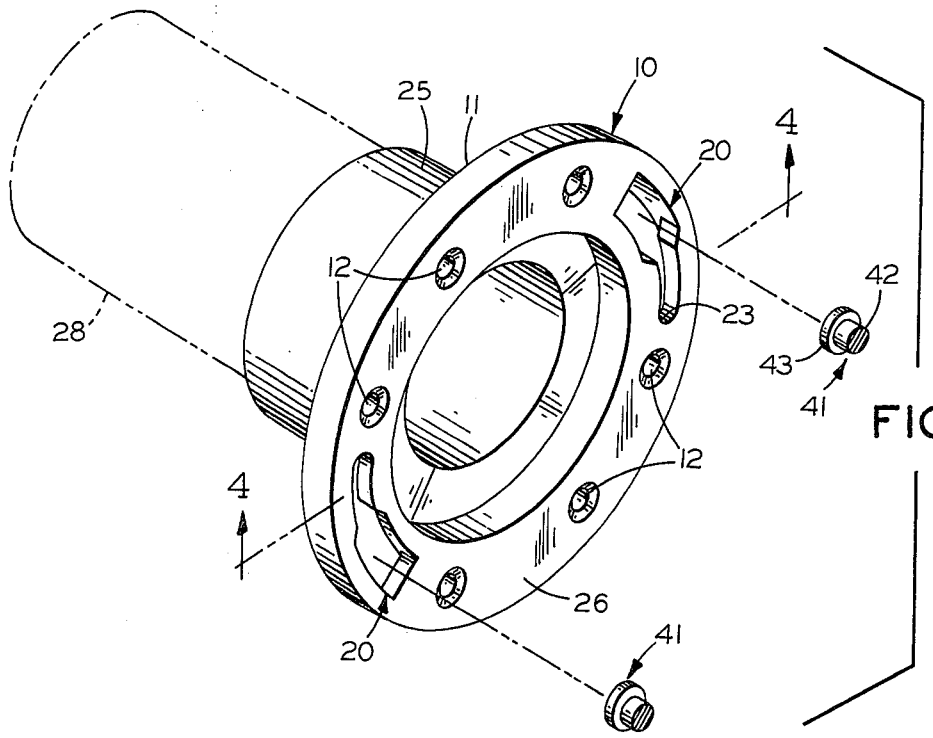
FIG. 1 is a perspective view of a water closet flange.

Referring now to the drawings and, more particularly, to FIG. 1 which shows a perspective view of a water closet flange with which the present invention is concerned. The flange section 10 contains holes 12 formed therein for conveniently securing the water closet flange to a floor or wall by means of screws (not shown). Water closets (not shown) are secured to the water closet flanges by the use of bolts (not shown). The bolts (not shown) are inserted in the elongated holes 20 which are on opposite sides of the flange section 10 and are then slid along the bolt head receiving slots to their final alignment position 23. The water closet flange must be positioned so that when the bolts are in the final alignment position 23, perfect alignment is obtained for proper mating with the bolt holes in the water closet.

Figure 2:
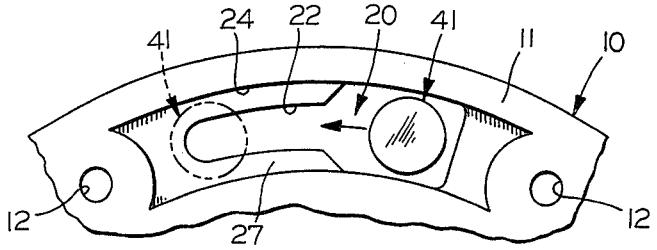
FIG. 2 shows a view of the bolt head receiving slots from the bottom surface of the water closet flange.

In FIG. 2, the recess 24 on the bottom surface 11 of the flange 10 is formed adjacent and normal to the inner portion of the elongated hole 20. The bolt head, when inserted into the bolt head receiving slot 22, rests on the recessed surface 27, and securely fixes the water closet flange to the water closet by means of a tightened nut (not shown). The recessed surface 27 is sufficiently below the bottom surface 11 of the flange 10 so that the bolt head does not protrude beyond the bottom surface 11.

Referring again to FIG. 1, the pipe flange 25 is typically constructed to have an inside diameter slightly larger than the diameter of the soil pipe 28 to which it is connected, so that the pipe flange 25 readily fits over the soil pipe 28.

When connecting the pipe flange 25 to the soil pipe 28, it is essential that the front surface 26 of the water closet flange 10 be vertically level so as to insure good surface engagement with the face of the water closet (not shown) for wall installations and horizontally level for floor installations. It is also essential that the final alignment position 23 of the water closet flange is such that the bolts (not shown) will engage the bolt holes and properly position the water closet. Water closet flanges installed in floors must have the axis of the final alignment position 23 parallel to the wall against which the water closet is being installed since an inaccuracy in the rotational position of the water closet flange will result in an undesirable positioning of the water closet.

Once the pipe flange is in place, the water closet flange 10 is properly aligned for receiving a water closet, and the pipe flange 25 is then secured to the soil pipe 28. The securing may be accomplished by welding or by lead caulking when metal water closet flanges are utilized or by the use of glue when plastic water closet flanges are used. When threaded soil pipes and water closet flanges are used, the pipe flange 25 must be turned onto the soil pipe to a sufficient depth to ensure a leak tight connection.

Alternatively, the pipe flange 25 can be constructed to have an outside diameter slightly less than the inside diameter of the soil pipe 28, so that the pipe flange 25 readily fits inside the soil pipe 28. Once in place, the pipe flange 25 can be secured to the soil pipe 28 in the manner mentioned above.

Figure 3:
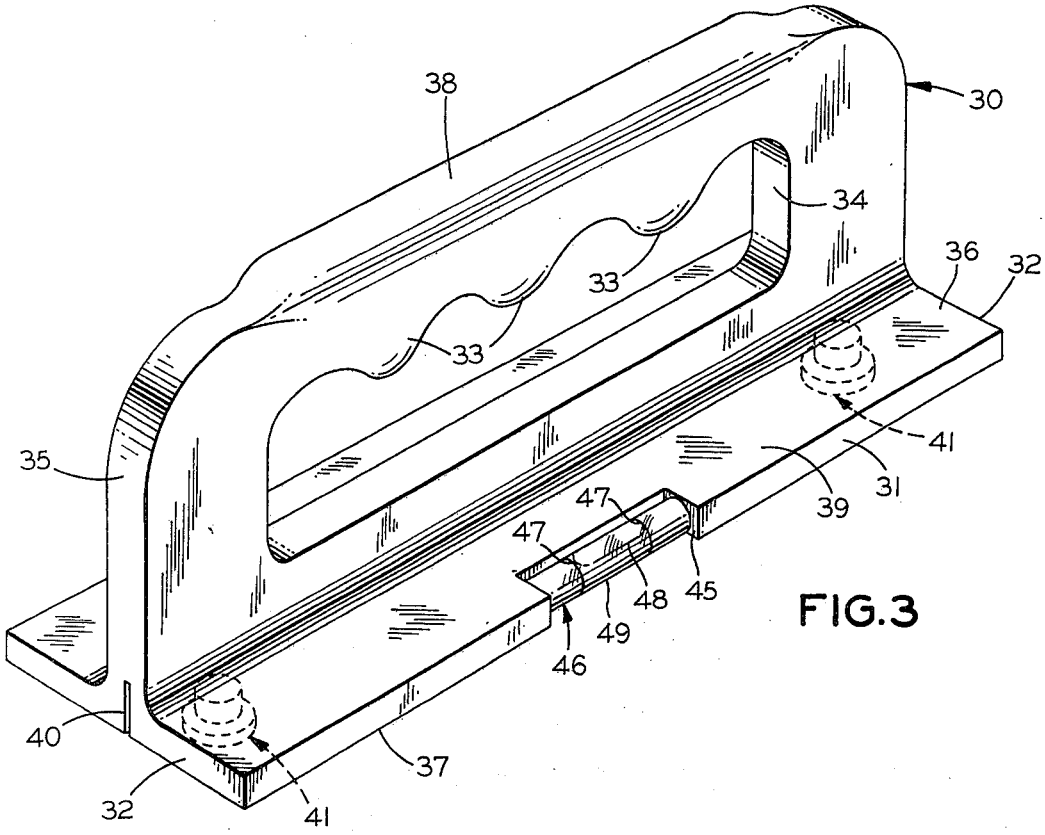
FIG. 3 is a perspective view of the invention, the water closet flange wrench and puller.

Referring now to FIG. 3, there is shown the present water closet flange wrench and puller, generally designated 30. The purpose of this tool is to level vertically the front surface of the water closet flange and to adjust horizontally the final alignment position for wall installations. In floor installations the tool is used to level horizontally the front surface of the water closet flange and to adjust properly the final alignment position with the wall. The water closet flange wrench and puller 30 is not only adapted for rotating the water closet flange to obtain proper leveling and alignment, but also to pull the water closet flange from the soil pipe when it has been improperly inserted or aligned before the water closet flange becomes permanently secured to the soil pipe.

The water closet flange wrench and puller 30 comprises a base element 36, a handle 35 perpendicularly attached to the base element 36, a spirit level 46 mounted in a cavity 45 in the base element 36, a pair of line-up studs 41 attached to the bottom surface 37 of the base element 36, and an alignment slot 40 on each end 32 of the base element 36.

More specifically, the water closet flange wrench and puller base element 36 is made of a suitably rigid material such as a flat stock of metal or sturdy plastic, which has a length at least as long as the diameter of a water closet flange and a width which is sufficient to push the water closet flange onto a soil pipe. The tool has sufficient strength to enable rotation of the water closet flange for alignment and removal purposes.

Figure 4:
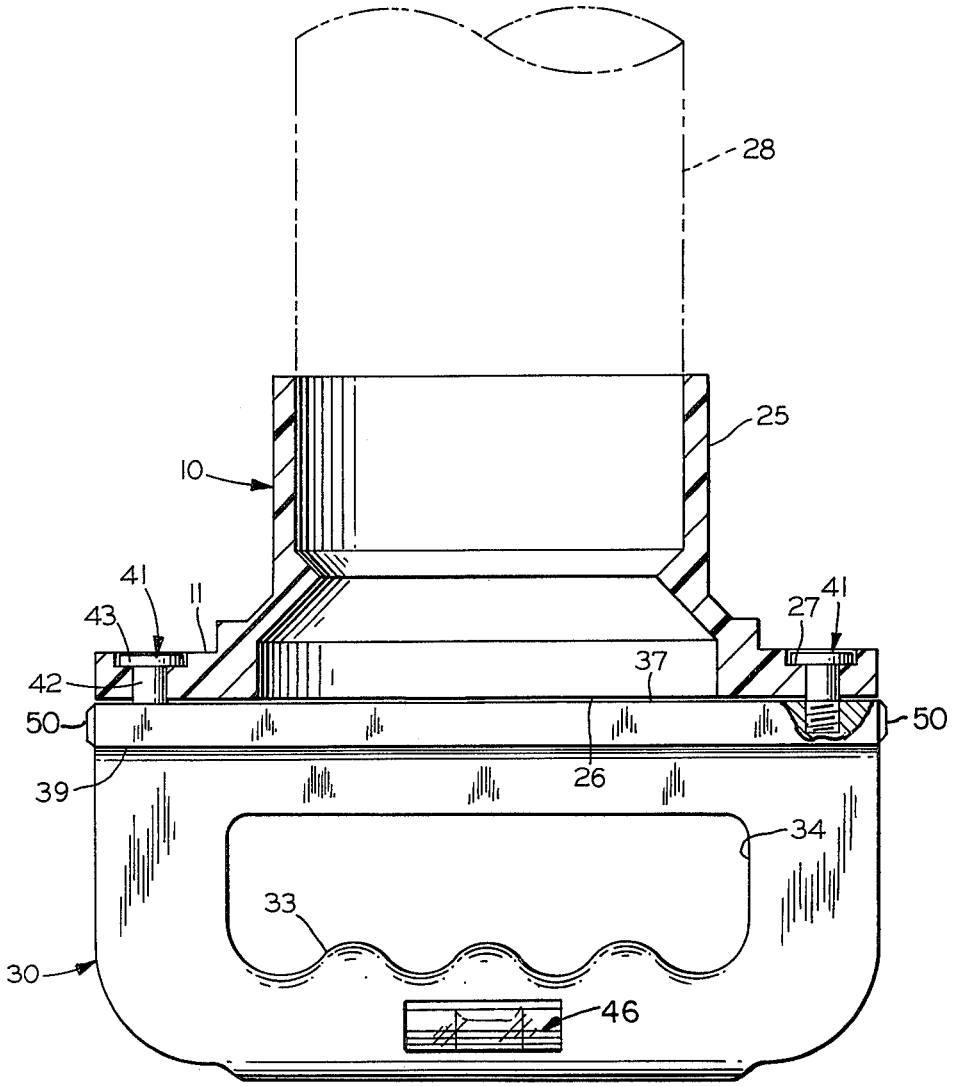
FIG. 4 is a sectional view showing the line-up studs of the water closet flange wrench and puller engaged in the bolt head receiving slots of the water closet flange.

The base element 36 is essentially flat on both surfaces and has a thickness substantially less than its width. For floor installations, the alignment slots 40, located on each end 32 of the base element 36, enable the positioning of the water closet flange along a plane parallel to the wall against which the water closet is being installed. At present, the procedure for alignment is to put marks on the floor to define the plane parallel to the wall. It is understood that the alignment slots could be alignment projections 50 as shown in FIG. 4.

The water closet flange wrench and puller handle 35 is perpendicularly attached to the top surface 39 of the base element 36. Said handle 35 contains a cavity 34 for grasping with one or both hands in order to rotate or apply a force in the forward or reverse direction. The cavity 34 may be utilized also for the insertion of a lever (not shown) in order to obtain a larger torque for rotating the water closet flange. This may be necessary in the removal of plastic water closet flanges in which the glue has hardened to the point where a large torque is required to break the bond as well as in the insertion and removal of threaded water closet flanges.

In the preferred embodiment, the handle member 38 defining the boundary of the cavity 34 furthest from the base element 36 has an extended thickness to provide ease of handling. Said cavity boundary of the handle member 38 is curved for finger grips 33.

According to the preferred embodiment of the invention, the leveling means is a spirit level 46 mounted in a cavity 45 in the base element 36 with the axis of the level parallel to the axis of the base element 36. The spirit level 46 includes a liquid filled tube 49 having a pair of leveling marks 47 which cooperate with the bubble 48 to indicate when the axis of the tool is exactly horizontal. Because of the symmetry of the construction, the leveling means 46 may be mounted in the base element 36 on either side of the handle 35. It is understood that the spirit level 46 could be inserted in the handle 35 as shown in FIG. 4.

The leveling means allows the horizontal leveling of the water closet flange final alignment position. Since the water closet flanges are installed before the water closets are installed, the water closet flanges must be in exact alignment. All water closet bolt holes are located on a horizontal line and horizontal leveling will insure a mating of the water closet holes with the water closet final alignment position. The thickness of the sides 31 of the base element 36 is sufficient to install the spirit level 46 so that it does not extend beyond the top surface 39 or the bottom surface 37 of the base element 36.

Referring to FIGS. 1, 2 and 3, the line-up studs 41 comprise a cylindrical body 42 which is attached at one end to the bottom surface 37 of the base element 36. The cylindrical body 42 may be threaded as shown in FIG. 4 for removeable insertion into the bottom surface 37 of the base element 36 or, it may be smooth and attached to the base element 36 by welding. The cylindrical body may also be cast or mold connected to the base element 36. The cylindrical body 42 has a diameter slightly smaller than the diameter of the bolt head receiving slot 22 of the water closet flange 10. The other end of the cylindrical body 42 contains a curvilinear shaped head element 43 having a diameter larger than the cylindrical body 42, but smaller than the diameter of the recess 24 on the bottom surface 11 of the water closet flange 10. The thickness of the head element 43 is such that it does not extend beyond the bottom surface 11 of the water closet flange 10 when the line-up studs 41 are inserted into the bolt head receiving slots 22 in the water closet flange 10.

FIG. 1 shows the line-up studs 41 in alignment with the radial positions of the bolt head receiving slot sections of the elongated holes 20 in the water closet flange.

FIG. 2 shows the relative movement of the line-up stud 41 as it is inserted into the elongated hole 20 and then slid into the final alignment position 23.

Referring now to FIG. 4 which is a sectional view of the tool engaged with the water closet flange 10. The bottom surface 37 of the base element is flat against the front surface 26 of the water closet flange 10 and the cylindrical body 42 of the line-up stud 41 is in the final alignment position. The curvilinear flat head element 43 attached to the cylindrical body 42 rests on the recessed surface 27 of the flange and prevents the wrench from being pulled away from the water closet flange when a force is applied by the tool normal to the front surface 26 of the water closet flange 10. The recessed surface 27 provides also the engaging means for rotating the water closet flange 10 in the clockwise or counterclockwise directions and for pulling the water flange 10 from the soil pipe 28. The top surface of the line-up stud head 43 does not extend beyond the bottom surface 11 of the water closet flange 10.

It can therefore be seen that in accordance with the present invention, there is provided a water closet flange wrench and puller which solves the problems of the installation, alignment and removal of water closet flanges encountered heretofore. The water closet flange wrench and puller is an easy-to-use, convenient tool for aligning water closet flanges for proper connection to water closets. This is particularly true in conjunction with the installation and alignment of plastic water closet flanges.

While the invention has been described with respect to a preferred physical embodiment constructed in accordance therewith, it will be apparent to those skilled in the art that various modifications and improvements may be made without departing from the scope and spirit of the invention. Accordingly it is to be understood that the invention is not to be limited by the specific illustrative embodiment, but only by the scope of the appended claims.

I claim:

1. A tool for the installation, alignment and removal of the water closet flange comprising:

a. a base element having a length at least as long as the diameter of the water closet flange, and a width sufficient to push the water closet flange onto a soil pipe;

b. a pair of line-up studs engagable with a respective pair of bolt head receiving slots in said water closet flange, said studs having a cylindrical body with a diameter of such size as to be accommodated in the bolt head receiving slot and fixedly attached at a first end to a bottom surface of the base element;

c. a head element attached to a second end of the cylindrical body having a diameter larger than the cylindrical body and slidably and fixedly engagable in the bolt head receiving slot in the water closet flange, said cylindrical body having a length such that the head element when engaged in the water closet flange does not extend beyond the bottom surface of the water closet flange;

d. a handle attached to a top surface of the base element in a perpendicular relation to the base element; and e. a spirit level mounted in a cavity in said tool for indicating the alignment of the water closet flange bolt head receiving slots for proper mating with a water closet.

2. A tool as set forth in claim 1 wherein the spirit level is mounted in a cavity in the base element.

3. A tool as set forth in claim 1 wherein grooves are located in each end of the base element, the center of said grooves being in a plane through the longitudinal axis of both line-up stud cylinders.

4. A tool as set forth in claim 1 wherein a projection is located on each of the opposite ends of the base element, the center of said projections being in a plane through the longitudinal axis of both line-up stud cylinders.

5. A tool as set forth in claim 1 wherein the spirit level is mounted in a cavity in said handle.

6. A tool as set forth in claim 1 wherein the cylindrical bodies of the line-up studs are threaded for removable attachment to the bottom surface of said base element.

* * * * *